United States Patent [19]

Ling

[11] 4,410,588

[45] Oct. 18, 1983

[54] PROCESS FOR SIZING TEXTILE YARNS

[75] Inventor: Chi-Fei Ling, Edison, N.J.

[73] Assignee: American Cyanamid Company, Stamford, Conn.

[21] Appl. No.: 268,925

[22] Filed: Jun. 1, 1981

[51] Int. Cl.[3] ..... B05D 3/02; B32B 7/00; B32B 23/00; D03D 3/00

[52] U.S. Cl. ..... 428/248; 252/8.8; 427/389.9; 427/392; 428/274; 524/831

[58] Field of Search ..... 427/389.9, 392; 524/831; 252/8.8; 428/248, 274

[56] References Cited

U.S. PATENT DOCUMENTS 3,297,613 1/1967 Gibbs ..... 524/831
3,696,082 10/1972 Smith ..... 524/831 X
4,070,319 1/1978 Carel et al. ..... 524/831 X
4,312,914 1/1982 Guth ..... 427/389.9

*Primary Examiner*—Michael R. Lusignan
*Attorney, Agent, or Firm*—Charles J. Fickey; H. G. Jackson

[57] ABSTRACT

This invention relates to a process for sizing textile yarns by treatment with copolymers, and/or multipolymers, of acrylamide, and to the products thereby obtained. Said composition comprises an aqueous solution of a segmented copolymer of acrylamide and at least one vinyl or vinylidene polymerizable monomer, the amount of the monomer being at a concentration from about 1% to about 40%, based on the weight of acrylamide in the composition.

8 Claims, No Drawings

PROCESS FOR SIZING TEXTILE YARNS

In accordance with the invention, there is provided a process for sizing textile yarns by treatment of the same with segmented copolymers, and/or multipolymers, of acrylamide, and at least one polymerizable monomer of formula (I)

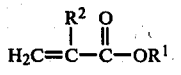

(I)

wherein $R^1$ represents hydrogen, $C_1$–$C_{18}$ alkyl, or substitued $C_1$–$C_{18}$ alkyl wherein the substituents are hydroxy, $C_1$–$C_8$ alkoxy, $C_1$–$C_8$ alkylamino, or di($C_1$–$C_8$ alkyl)amino, and $R^2$ represents $C_1$–$C_4$ alkyl and hydrogen.

In accordance with the invention, there are also obtained abrasion-resistant products obtained by the sizing process of the invention.

The use of homopolymers of acrylamide as sizing agents for warp yarns, to prevent breaking of the yarn during weaving, is well-known. They perform only slightly better than starch, a commonly employed textile size that imparts only minor protection to fibers during weaving. The moderate performance of polyacrylamide and starch is due to the brittleness of their films on the fiber.

Although random copolymers of acrylamide and other vinyl, or vinylidene monomers have also been used as sizes for warp yarns, almost invariably the acrylamide they contain is a minor component of the copolymer. Consequently, such sizes are, therefore, often water-insoluble and difficult to desize.

The use of a random copolymer of acrylamide and acrylic acid, containing a minor amount of acrylic acid monomer, as a sizing agent, is disclosed by Petrov et al (see Chem. Abstracts 90:105488b). However, these sizes have two components that are both polar and hydrophilic, whereas the sizes of this invention involve at least one hydrophobic and less polar component that can alter the properties of the product such as lubricity, adhesion, and film flexibility.

In the preparation of random copolymers of acrylamide, acrylamide and the comonomer, or comonomers, are well-mixed in a reaction vessel before initiating polymerization.

In the preparation of segmented copolymers, structures in the form of grafts or blocks are achieved by the sequential addition of the monomers as the polymerization progresses.

The segmented copolymers of the invention which may be a graft or a block copolymer, or a mixture of both, generally produce more flexible films, especially at low relative humidities, and impart better abrasion resistance to warp yarns than random copolymers, or a mixture of a random copolymer and homopolymers having an identical monomer composition as the segmented copolymer. For example, a blended mixture of a random copolymer of acrylamide and 2-ethylhexyl acrylate, poly(n-butyl acrylate), and polyacrylamide does not perform as well as a segmented copolymer, having an identical monomer composition, in terms of both film flexibility and abrasion resistance.

Other advantages of segmented copolymers are as follows:

1. They impart better yarn-to-yarn and yarn-to-metal abrasion resistance for yarns than starch, or polyacrylamide sizes.

2. They can be applied from more concentrated solutions than starch. This permits an application with less water, thus saving drying time and energy.

3. The pad baths are more easily prepared because of the high solubility of the size in water.

4. The application solutions are stable, and do not retrograde like those containing starch.

5. The polymeric sizing agent is readily removed from the textile substrate by rinsing with cold water.

6. The treated yarns do not have any dry splitting difficulty during slashing.

In preparing the composition to be applied in the process of this invention, 30–99% by weight of acrylamide, and about 0–20% by weight of a polymerizable monomer of formula (I), or mixture of these monomers, is polymerized randomly in an aqueous medium, under an inert atmosphere, in the presence of a surface-active agent and a catalytic amount of a free-radical source, such as ammonium persulfate, ammonium persulfate and sodium bisulfite, and the like. A second charge of 1–20% by weight of a polymerizable monomer, or mixture of monomers, of formula (I), based on the total weight of polymer, is added from 5 minutes to 5 hours after the addition of the catalyst, and the reaction mixture is stirred for 10–60 minutes. Preferably, the second charge is added at the peak of the ensuing exotherm, after the addition of the catalyst, when very little monomer remains. Optionally, 1–30% by weight of a water-soluble vinylic monomer, such as acrylamide, acrylic acid, or methacrylic acid, based on the total weight of polymer, may be added as a third charge. The reaction mixture is stirred under the inert atmosphere until the copolymerization is essentially completed. The product is a semi-viscous solution that can be applied directly to the textile substrate.

Suitable polymerizable monomers of formula (I) include the following:

methyl acrylate,
ethyl acrylate,
n-butyl acrylate,
2-ethylhexyl acrylate,
2-hydroxyethyl acrylate,
2-methoxyethyl acrylate,
methyl methacrylate,
n-dodecyl methacrylate,
n-octadecyl methacrylate,
N,N-dimethyl-12-aminododecylacrylate,
12-hydroxydodecyl acrylate,
12-methoxydodecyl methacrylate,
acrylic acid,
methacrylic acid,
N-2-ethylhexyl-2-aminoethyl acrylate,
N-tert-butyl-2-aminoethyl methacrylate,
N,N-dimethyl-2-aminoethyl acrylate,
N,N-diethyl-2-aminoethyl methacrylate,
and the like.

The preferred comonomers are n-butyl acrylate and 2-ethylhexyl acrylate.

Optionally, starch or other sizes may be blended with the product and other conventional additives, such as plasticizers, may be added to the solution before application. Suitable plasticizers include glycerol, ethanolamine, ethylene glycol, polyethylene glycol, urea, sugar, sorbitol, and the like.

The application of the sizing composition to the textile material may be by padding (conventional, or high pressure), foaming, spraying, knife-coating, and the like, to deposit thereon about 3–15%, preferably 6–12%, by weight of real solids from the aforementioned reaction mixture. Suitable textile materials include filaments, spun yarns, or fabrics of natural or synthetic fibers, or blends thereof. The preferred substrate material is cotton, or cotton/polyester warp yarn.

The treated textile substrate is then dried by heating at 80°–120° C. for a period of about 15 to 0.25 minutes, preferably at 95°–105° C. for a period of about 2 to 0.5 minutes. Optionally, the treated substrate may be dried at a lower temperature, such as by standing at room temperature until dry.

The process of this invention produces a size coating on the textile substrate which is characterized by easy removal by subsequent washing. The treated textile substrate is characterized by excellent abrasion resistance.

The following examples illustrate the process of the present invention. All parts and percentages are by weight unless otherwise indicated.

EXAMPLE 1

A mixture of 152 grams of an aqueous solution of acrylamide (50% real solids), 4.0 grams of 2-ethylhexyl acrylate, 1.0 gram of AEROSOL® OT-75% (American Cyanamid Company), and 272 grams of water is stirred under nitrogen for 20 minutes at 30°–35° C. Solutions of 0.4 gram of ammonium persulfate in 5 grams of water, and 0.4 gram of sodium metabisulfite in 5 grams of water are added thereto and the temperature is allowed to rise spontaneously. At the peak of the resulting exotherm, 10 grams of 2-ethylhexyl acrylate is added. The reaction mixture is stirred for one hour, and then cooled to 25° C. to obtain a solution having a viscosity of 340 centipoises, and a polymer content of 20% by weight.

EXAMPLE 2

A mixture of 174.7 grams of an aqueous solution of acrylamide (50% real solids), 3.5 grams of 2-ethylhexyl acrylate, 1.2 grams of AEROSOL® OT-75%, and 194 grams of water is stirred under nitrogen for 20 minutes at 30°–35° C. Solutions of 0.5 gram of ammonium persulfate in 6 grams of water, and 0.5 gram of sodium metabisulfite in 6 grams of water are added thereto and the temperature is allowed to rise spontaneously. At the peak of the exotherm, 9.2 grams of n-butyl acrylate is added. The reaction mixture is stirred for one and a half hours, then cooled to 25° C. to obtain a solution having a viscosity of 600 centipoises, and a polymer content of 25% by weight.

EXAMPLE 3

A mixture of 152 grams of an aqueous solution of acrylamide (50% real solids), 4.0 grams of 2-ethylhexyl acrylate, 1.0 grams of AEROSOL® OT-75%, and 332 grams of water is stirred under nitrogen for 20 minutes at 30°–35° C. Solutions of 0.4 grams of ammonium persulfate in 5 grams of water, and 0.4 gram of sodium metabisulfite in 5 grams of water are added thereto and the temperature is allowed to rise spontaneously. At the peak of the exotherm, 10 grams of styrene is added. The mixture is stirred for 30 minutes, and 40 grams of 50% aqueous acrylamide is then added thereto. After one hour of continued stirring, the reaction mixture is cooled to 25° C. to obtain a solution having a viscosity of 400 centipoises and a polymer content of 20% by weight.

EXAMPLE 4

A mixture of 152 grams of an aqueous solution of acrylamide (50% real solids), 4.0 grams of 2-ethylhexyl acrylate, 1.0 gram of AEROSOL® OT-75%, and 260 grams of water is stirred under nitrogen for 20 minutes at 30°–35° C. Solutions of 0.4 gram of ammonium persulfate in 5 grams of water, and 0.4 gram of sodium metabisulfite in 5 grams of water are added thereto, and the temperature is allowed to rise spontaneously. At the peak of the exotherm, 10 grams of n-butyl acrylate is added. The reaction mixture is stirred for 30 minutes, and 10 grams of acrylic acid is then added to the reaction mixture. After one hour of continued stirring, the reaction mixture is cooled to 25° C. to obtain a solution having a viscosity of 220 centipoises and a polymer content of 20% by weight.

EXAMPLE 5

A mixture of 2165 grams of an aqueous solution of acrylamide (50% real solids), 32.7 grams of 2-ethylhexyl acrylate, 8.2 grams of AEROSOL® OT-75%, and 500 grams of water is stirred under nitrogen for 20 minutes at 20°–25° C. Solutions of 2.9 grams of ammonium persulfate in 43 grams of water, and 2.9 grams of sodium metabisulfite in 43 grams of water are added thereto, and the temperature is allowed to rise spontaneously. At the peak of the exotherm, 81.8 grams of n-butyl acrylate is added. The reaction mixture is stirred for 20 minutes, and 327 grams of 50% aqueous acrylamide is then added. After one hour of continued stirring, the reaction mixture is cooled to 25° C. to obtain a solution having a viscosity of 720 centipoises, and a polymer content of 20% by weight.

EXAMPLE 6

A mixture of 152 grams of an aqueous solution of acrylamide (50% real solids), 4.0 grams of n-butyl acrylate, 1.0 gram of AEROSOL® OT-75%, and 332 grams of water is stirred under nitrogen for 20 minutes at 30°–35° C. Solutions of 0.6 gram of ammonium persulfate in 5 grams of water, and 0.6 gram of sodium metabisulfite in 5 grams of water are added thereto and the temperature is allowed to rise spontaneously. At the peak of the exotherm, 10 grams of n-butyl acrylate is added. The reaction mixture is stirred for 20 minutes, and 40 grams of 50% aqueous acrylamide is then added. After one hour of continued stirring, the reaction mixture is cooled to 25° C. to obtain a solution having a viscosity of 720 centipoises, and a polymer content of 20% by weight.

EXAMPLES 7–12

The solutions from Examples 1–6 are diluted with water to obtain a polymer content of 10% by weight are applied separately, by padding, to single-end 100% cotton yarns to obtain a 60% pickup based on the weight of the untreated yarn. The treated yarns are dried at 105° C. for one minute and tested for abrasion resistance using a modified Stoll flex abrader. In this test five strands of the treated yarns are attached to a Stoll flex abrader so that all are flexed over a stainless steel blade at a 90° angle using an attached 20-gram weight as a pulling force. The motor is started and the number of cycles needed to break each yarn is determined. This procedure is repeated three times for similarly treated yarns and an average is taken. The larger the number of cycles, the better the abrasion resistance imparted to the yarn.

The results obtained are shown in Table I.

TABLE I

| Example | Sizing Agent | Average Abrasion Resistance (cycles) |
|---|---|---|
| 7 | Product of Example 1 | 149 |
| 8 | Product of Example 2 | 200 |
| 9 | Product of Example 3 | 152 |
| 10 | Product of Example 4 | 165 |
| 11 | Product of Example 5 | 216 |
| 12 | Product of Example 6 | 215 |
| | Untreated cotton yarn | 62 |

EXAMPLES 13–15

Solutions containing 10% by weight, respectively, of starch; a random terpolymer of acrylamide, n-butyl acrylate, and 2-ethylhexyl acrylate having the same monomer composition as in Example 5; and a blended mixture of a copolymer of acrylamide and 2-ethylhexyl acrylate, poly(n-butyl acrylate), and poly(acrylamide) having the same monomer composition as in Example 5, are prepared and applied to single-end 100% cotton yarns as described in Examples 7–12.

The results obtained are shown in Table II.

TABLE II

| Example | Sizing Agent | Average Abrasion Resistance (cycles) |
|---|---|---|
| 13 | Starch | 92 |
| 14 | Terpolymer | 156 |
| 15 | Blended mixture | 176 |
| | Untreated cotton yarn | 62 |

Comparison of the results obtained in Example 14 and 15 with that obtained in Example 11 shows that superior abrasion resistance is obtained with the segmented copolymer of Example 5.

I claim:

1. A process for sizing a textile substrate material comprising applying to the textile material a composition comprising an aqueous solution of at least 3% by weight solids content of a segmented copolymer of acrylamide and at least one vinyl or vinylidene polymerizable monomer, the amount of the polymerizable monomer in the composition being at a concentration from about 1% to about 40%, based on the weight of acrylamide in the composition, and thereafter drying the treated substrate, the composition being applied in an amount and the drying being at a temperature, respectively, sufficiently high to impart a high order of abrasion resistance to the textile material, the composition being capable of being removed from said textile substrate material by aqueous washing.

2. The process according to claim 1 wherein the composition comprises a solution in water of a segmented copolymer of claim 1 at a concentration from about 5% to about 30% by weight of the segmented copolymer, based on the weight of the composition, the composition being applied to the textile material to deposit the copolymer in an amount from about 3% to about 15% by weight, based on the weight of the material, and drying the same at a temperature ranging from about 80° C. to about 120° C. for about 15–0.25 minutes.

3. The process according to claim 2 wherein the amount of segmented copolymer deposited on the textile material is from about 6% to about 12% by weight, based on the weight of the material, and drying the same at a temperature from about 95° C. to about 105° C. for about 2–0.5 minutes.

4. The process according to claim 1 wherein the textile material is a cotton yarn, cotton/polyester yarn or polyester yarn.

5. The process according to claim 2 wherein the vinyl polymerizable monomer is a $C_4$–$C_{18}$ alkyl acrylate, or a $C_4$–$C_{18}$ alkyl methacrylate.

6. The process according to claim 5 wherein the $C_4$–$C_{18}$ alkyl acrylate is a mixture of 2-ethylhexyl acrylate and n-butyl acrylate.

7. The process according to claim 6 wherein the $C_4$–$C_{18}$ alkyl acrylate is n-butyl acrylate.

8. The treated textile material of claim 4.

* * * * *